US007922916B1

(12) United States Patent
Witt

(10) Patent No.: US 7,922,916 B1
(45) Date of Patent: Apr. 12, 2011

(54) COMPRESSION FIT STORM WATER CURB INLET FILTER

(76) Inventor: Carey Witt, Austin, TX (US)

( * ) Notice: Subject to any disclaimer, the term of this patent is extended or adjusted under 35 U.S.C. 154(b) by 152 days.

(21) Appl. No.: 12/425,014

(22) Filed: May 7, 2009

(51) Int. Cl.
*E03F 5/06* (2006.01)

(52) U.S. Cl. ..... 210/747; 210/767; 210/162; 210/163; 210/170.03; 210/232; 210/474; 210/489; 210/497.01

(58) Field of Classification Search ..... 210/747, 210/767, 162, 163, 170.03, 232, 473, 474, 210/478, 483, 488, 489, 497.01; 404/4, 5
See application file for complete search history.

(56) References Cited

U.S. PATENT DOCUMENTS

| | | | | |
|---|---|---|---|---|
| 2,669,197 | A * | 2/1954 | Van Duzer | 210/162 |
| 6,015,489 | A * | 1/2000 | Allen et al. | 210/163 |
| 6,698,595 | B2 * | 3/2004 | Norell et al. | 210/488 |
| 6,811,708 | B2 * | 11/2004 | Shaw et al. | 210/747 |
| 6,974,540 | B1 * | 12/2005 | Fleischmann | 210/163 |
| 7,238,279 | B2 * | 7/2007 | Saurenman et al. | 210/163 |
| 7,300,574 | B1 * | 11/2007 | Lewis | 210/163 |
| 7,357,861 | B2 * | 4/2008 | Kelley et al. | 210/162 |
| 2002/0020658 | A1 * | 2/2002 | Isaacson | 210/162 |
| 2008/0134587 | A1 * | 6/2008 | Ealer | 210/162 |

* cited by examiner

*Primary Examiner* — Christopher Upton
(74) *Attorney, Agent, or Firm* — Rick B. Yeager

(57) ABSTRACT

A curb inlet filter is force fit into the throat of a curb inlet to filter debris and sediment from storm water entering an inlet. The device has a filter media affixed to the lower portion of a semi-rigid "C" shaped frame with upper retention flange. The shape and upper flange of the device combine to create a secure compression fit into the receiving inlet. The design includes an overflow feature above the extents of the filter media for heavy storm events. The "C" shape of the filter and placement within the throat of the curb inlet encourages sediment and debris to be captured within the device away from pedestrian and vehicular traffic. The device can easily be removed from the curb inlet while retaining the collected sediment and debris. The captured contaminants can be disposed of by emptying the contents in a designated area.

20 Claims, 3 Drawing Sheets

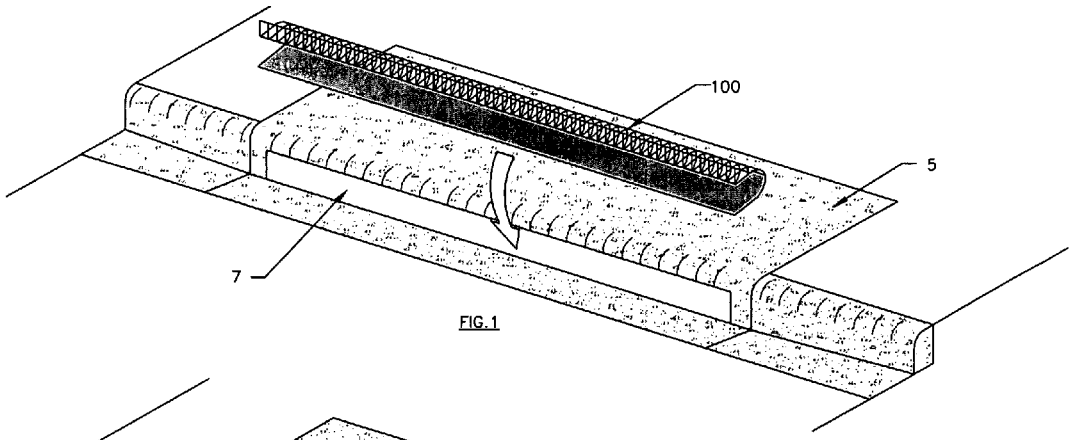
FIG. 1
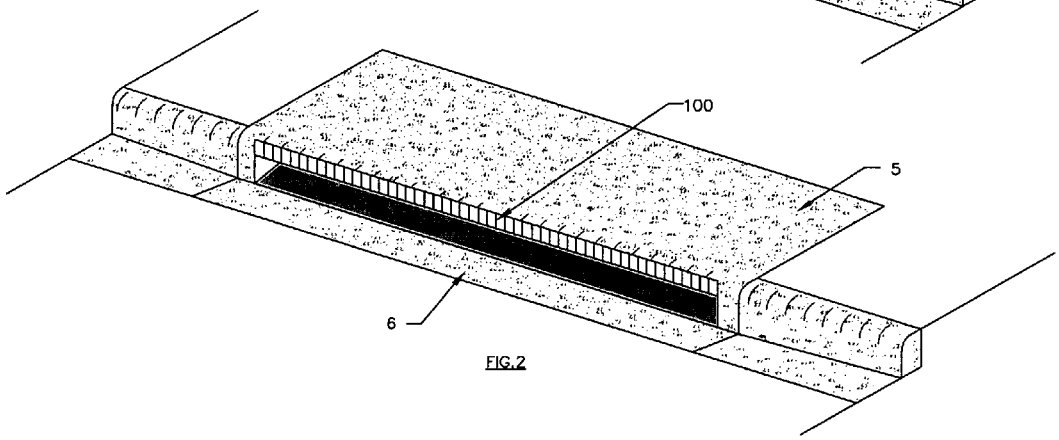
FIG. 2
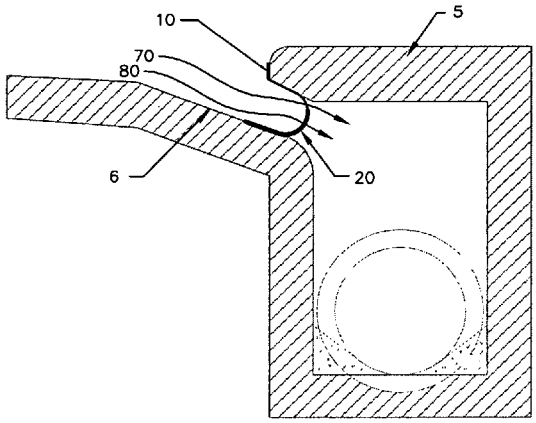
FIG. 3-A

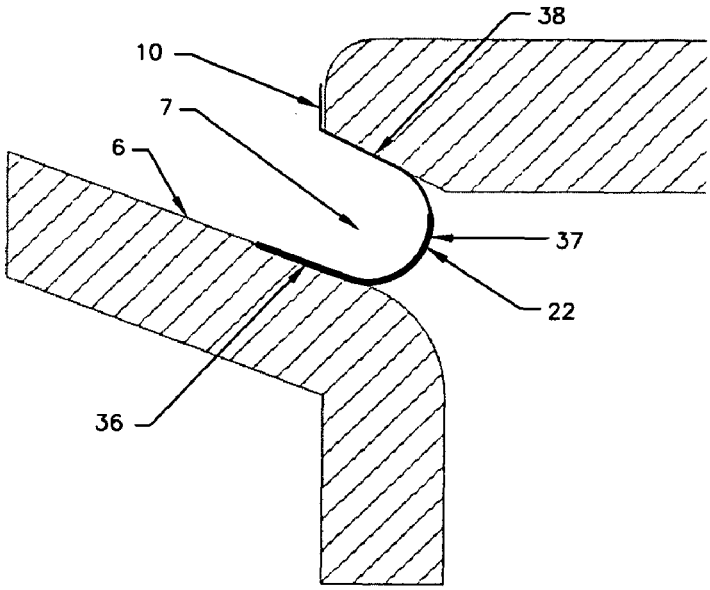
FIG.3–B
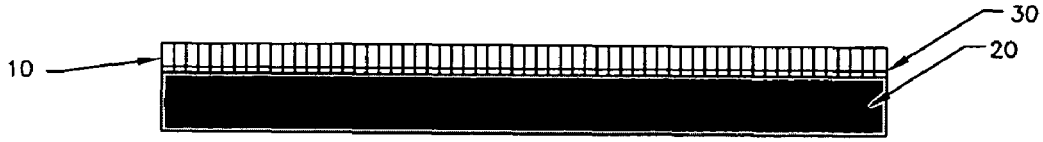
FIG. 4
FRONT VIEW
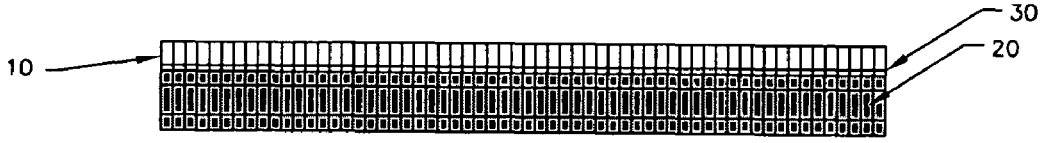
FIG. 5
BACK VIEW
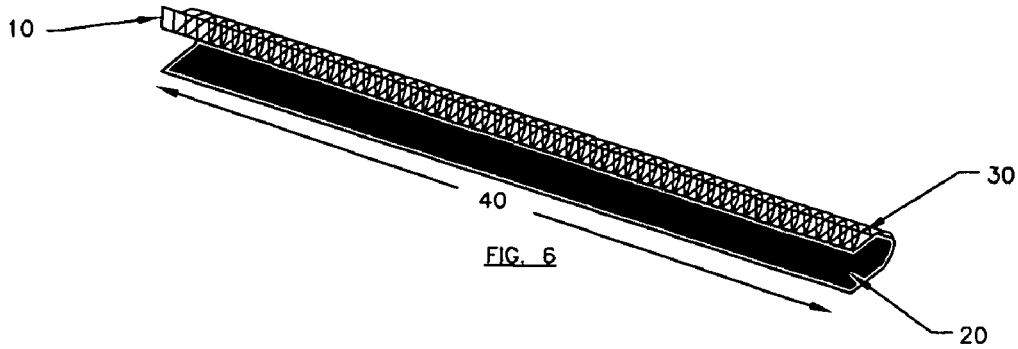
FIG. 6

COMPRESSION FIT STORM WATER CURB INLET FILTER

FIELD OF THE INVENTION

This invention is a curb inlet filter used to extract debris and sediment from storm water which would otherwise be transported into drainage inlets, thus minimizing pollution that would otherwise degrade the downstream waterways.

RELATED ART

Storm water from construction sites carries sediment and debris that enter the storm drainage system through drainage curb inlets. In an effort to minimize pollution of downstream waters, municipalities require inlet filters to be placed around curb inlets. Inlet filters range from filter socks or tubes to gravel filled bags that are designed to impede flow into curb inlets thus allowing sediment and debris to collect in front of the device and not enter the storm drainage system through the curb inlet. The primary shortcomings of these devices are that they are placed in front of the curb inlet such that the collected sediment and debris, and often times the device itself, become traffic hazards and only marginally filter storm water. Maintenance of the filter devices is difficult to perform without allowing the collected sediment and debris to enter the curb inlet. As the inlet devices become ineffective or the collected sediment and debris clog the inlet, the primary function of the curb inlet is inhibited and the storm water that is intended to enter the curb inlet can cause street flooding.

SUMMARY OF THE INVENTION

In the current invention, a curb inlet filter is placed into the throat of a storm drain curb inlet to filter debris and sediment that is transported by storm water runoff and which would otherwise be carried into the storm drainage system.

In one embodiment, the invention comprises a semi-rigid frame that is sized and shaped to fit into the throat of a curb inlet such that no additional connection elements are necessary to insure a tight fit into the inlet throat. The semi-rigid frame is formed into a convex "C" shape slightly taller than the size of the curb inlet opening. As this semi-rigid frame is forced into the curb inlet opening, it is forced into compression, thereby creating and maintaining a tight fit in the inlet throat. Additionally, an outward facing "L" shape or leg is formed along the top edge of the rigid frame. This leg or flange is placed against the top of the curb inlet face to hold the device in place. The lower half of the frame may be covered with one of a variety of filter media, such as woven and non-woven geotextiles and open cell foam rubber. The placement of the filter media in the bottom portion of the device only leaves the upper portion of the device uncovered for overflow during heavy storm water events.

The device can be easily removed from the curb inlet by pulling on the bottom of the semi-rigid frame. The debris and sediment that is captured in the device is retained as the device is removed from the inlet and can be disposed of by dumping the device upside down in an appropriate area.

In one embodiment, the semi-rigid frame is formed from a 12 gauge welded wire fence material with 2 inch×4 inch openings. The primary shape of the form is a "C" shape. The filter media is a woven mono-filament polypropylene filter fabric. The filter media may be secured to the frame by ties, hog rings, or other means.

In another embodiment, the semi-rigid frame comprises plastic formed into a "C" shape and outward facing leg or flange. The plastic frame has openings that allow water to pass through the plane of the frame. The lower half of the frame is covered with a woven mono-filament polypropylene fabric filter media.

In another embodiment, the lower half of the semi-rigid frame is covered with an open cell foam rubber which acts as the filter media.

In another embodiment, the filter media is comprised of a non-woven filter fabric.

In another embodiment, the filter media is a combination of filter fabric and open cell foam rubber.

In another embodiment, the semi-rigid frame acts as a supporting element for a sediment capture tube or roll.

BRIEF DESCRIPTION OF THE DRAWINGS

FIG. 1 is an exploded perspective view of one embodiment of a curb inlet filter 100 and a curb inlet.

FIG. 2 is a perspective view of the curb inlet filter 100 of FIG. 1 inserted into the curb inlet.

FIG. 3A is a cross-section of a curb inlet 5 showing the relative placement of the curb inlet filter of FIG. 2.

FIG. 3B is a cross-section of the curb inlet filter of FIG. 3A showing portions of the curb inlet and curb inlet filter frame.

FIG. 4 is a front view of the curb inlet filter of FIG. 3A.

FIG. 5 is a back view of the curb inlet filter of FIG. 3A.

FIG. 6 is a perspective view of the curb inlet filter of FIG. 3A.

DESCRIPTION OF EMBODIMENT

Curb Inlet Filter with Compression Frame

Figure 7:
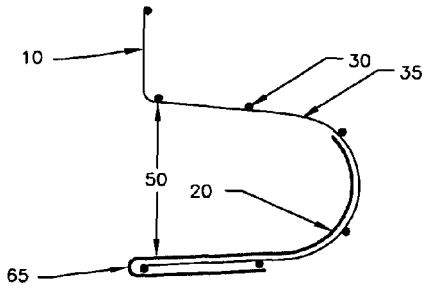
FIG. 7 is a cross-section of a curb inlet filter in the uncompressed state.

FIG. 1 is an exploded perspective view of a curb inlet 5 showing the general placement of a curb inlet filter 100 into the throat 7 of the curb inlet. FIG. 2 is a perspective view of the curb inlet filter 100 of FIG. 1 inserted into the throat 7 of the curb inlet 5.

FIG. 3A is a cross-section of a curb inlet 5 showing the relative placement of the curb inlet filter of FIG. 2. FIG. 3A shows that the curb inlet filter is forced into the throat 7 of a curb inlet 5 such that the device is forced into compression as the height of the opening in the uncompressed state, 50 (see FIG. 7), is larger than the height of the throat of the curb inlet and the corresponding height of the curb inlet filter in the compressed state, 60 (see FIGS. 3A and 8). FIG. 3 shows other elements including the concrete gutter 6 of the curb inlet; and the flange 10 of the curb inlet filter. Filter media 20 of the curb inlet filter is supported by the filter frame as described below. FIG. 3 also shows storm water flow 70 through the overflow space directly above the filter media of the curb inlet filter, and storm water flow 80 through the filter media of the device. In other examples, the retention function of the lip or flange 10 may be provided with one or more tabs.

Compression Frame

Figure 8:
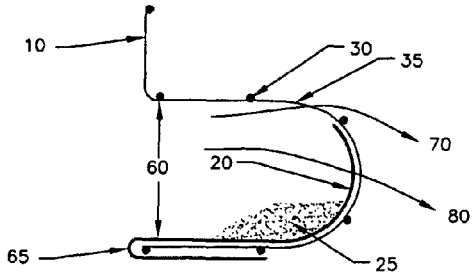
FIG. 8 is a cross-section of the curb inlet filter of FIG. 7 as it is compressed and placed within the throat of a curb inlet.
Figure 12:
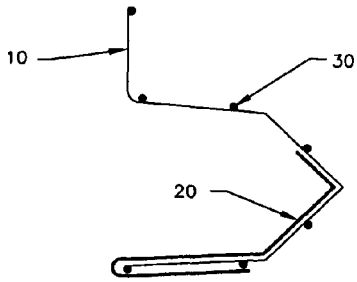
FIG. 12 is a cross-section of a curb inlet filter with a polygonal shaped semi-rigid frame.
Figure 13:
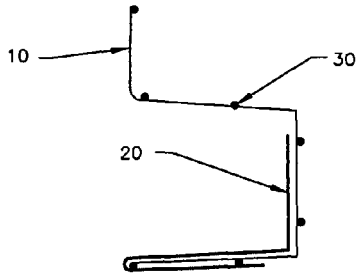
FIG. 13 is a cross-section of a curb inlet filter with a polygonal shaped semi-rigid frame.

In FIG. 3B, the convex inset portion 22 of the frame is shown as a "C" shape having a bottom portion 36 which contacts the concrete gutter 6, a rounded middle portion 37, and an upper portion 38 which contacts the top of the throat, 7, of the curb inlet. One aspect of the current invention is that the frame is retained in the throat by a spring force created by the frame against the top and bottom portions of the throat. Other cross sections of frame shape may be used to accomplish this force, including a polygonal shape such as shown in FIGS. 12 and 13. In addition to the spring force, friction forces also help to retain the frame in place, so it is generally desirable to have large throat contact surfaces, 36 and 38 such as shown in FIGS. 3B and 8.

FIGS. 4-8 show the general form or shape of one embodiment of the curb inlet filter device as a "C" shape with an outward facing leg or flange on the top edge.

FIGS. 3-8 show that a filter media 20 connected to the semi-rigid frame 30 of the device. In one example, the frame 30 is a 12 gauge galvanized welded wire fence material with 2 inch×4 inch openings manufactured to the length of the receiving curb inlet.

The semi-rigid frame can also be made of plastic.

The curb inlet filter is dimensioned to fit into the throat of the receiving curb inlet. The length 40 of the curb inlet filter matches the length of the curb inlet, typically 5 feet to 10 feet. The height of the compressed curb inlet filter matches the height of the curb inlet throat, typically 6 inches to 7.5 inches.

Length Adjustment

The device can be shortened as necessary to fit within the target curb inlet by bending the longitudinal frame wires on one end of the device toward the front of the inlet filter with a pair of pliers.

Alternatively, the device can be fitted with a supplemental formed wire extension frame, such 6 inches long. The extension frame is attached to the backside of the device such as by connecting corresponding longitudinal wires with hog ring fasteners. The filter media is extended beyond the length of the original frame by approximately 1 inch and is attached to the end of the extension frame.

The device can be adjusted in length by sliding the extension frame in or out to modify the overall length of the device.

Filter Media

Figure 11:
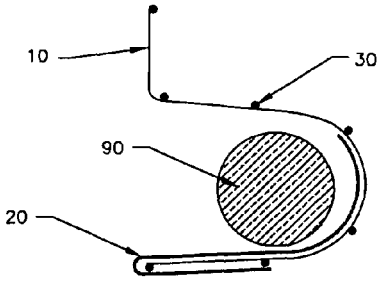
FIG. 11 shows curb inlet filter being used as a receptacle within which to place a sediment capture tube or roll to maximize filtration and removal of contaminants from storm water.

The filter media can be comprised of a variety of materials known to have filtration characteristics. The typical filter media is a woven mono-filament polypropylene filter fabric. The filter media can also be non-woven filter fabric, open cell foam rubber or combinations of these filter materials. The degree of filtering or sediment removal can be varied by varying the porosity and thickness of the filter media. The device can also be used as a receptacle within which to place a sediment capture tube or roll 90 such as shown in FIG. 11 to maximize filtration and removal of contaminants from storm water.

FIGS. 3-8 show that the filter media, 20, may be connected only to a lower portion of the device, thus leaving the upper portion of the device open for storm water overflow, 70, in the event of heavy storm events.

FIGS. 4-8 show a variety of views that depict the filter media being placed on the lower half of the front side or water filtering side of the device. The semi-rigid frame acts as a supporting element of the filter media.

Installation and Operation

FIGS. 2 and 3 show the device placed into a curb inlet. The leg or flange 10 of the device is placed against the upper face of the curb inlet. The flange 10 coupled with the compression fit of the device insures a secure fit into the inlet and prevents the device from entering the curb inlet.

FIGS. 4 and 5 are front and back views, respectively, of one embodiment of the curb inlet filter device.

FIG. 7 is a cross-section of the device in the uncompressed state. The height of the throat 50 of the device is greater than the throat of the receiving curb inlet.

FIG. 8 shows the device in the compressed state after it is forced into the receiving curb inlet. The device is forced into compression as it is forced into the receiving curb inlet, causing the uncompressed throat 50 dimension to be decreased to the compressed throat 60 dimension. The resulting compression fit insures a secure fit into the inlet and forces the lower outermost leading edge or lip 65 to be pushed against the concrete gutter 6 of the curb inlet. This downward force on the leading edge insures a tight fit against the gutter, forcing storm water to enter the curb inlet filter. FIG. 8 shows a portion of the filter media wrapping around the lip 65 so that storm water does not run between the frame and the media or under the curb inlet filter. In other examples, other means of creating a seal are provided such as bending the lip 65 over the media, or placing a plastic full length retaining clip over the lip to attach the fabric to the frame and create a seal.

FIGS. 3A and 8 show the flow 80 of storm water into the device and through the filter media 20 of the curb inlet filter. The filter media will retain debris and sediments that are being transported by storm water into the storm drainage system through the curb inlet opening. Differing degrees of filtration can be accomplished by varying the porosity and thickness of the filter media. During heavy storm events, large volumes of storm water runoff will enter the storm drainage system through curb inlets. By only covering the lower half of the semi-rigid frame 30 with filter media, an overflow space 35 is created in the top portion of the device when placed into the throat of the inlet. During heavy storm events, large volumes of storm water runoff must be able to enter the curb inlet. A portion of the storm water 70 during the heavy storm events will enter the curb inlet through the integrated overflow space 35. The overflow feature will allow the curb inlet filter to function during heavy storm events.

The curb inlet filter is easily removed from the curb inlet by pulling on the semi-rigid frame from the bottom of the device.

The sediment and debris 25 that is captured by the curb inlet filter is collected at the back of the device against the filter media. As the curb inlet filter is removed from the curb inlet, the collected sediment and debris 25 is retained within the device and can be disposed of by carrying the device to an appropriate area and turning the device upside down to dump the collected materials.

Figure 9:
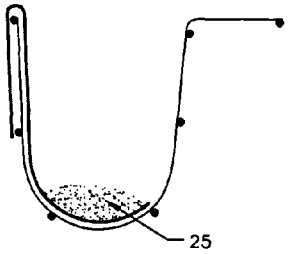
FIG. 9 is a view of the curb inlet filter of FIG. 7 after it has collected sediment and debris, 25, and has been removed from a curb inlet.

FIG. 9 is a view showing a curb inlet filter that has collected sediment and debris 25 and has been removed from a curb inlet.

Figure 10:
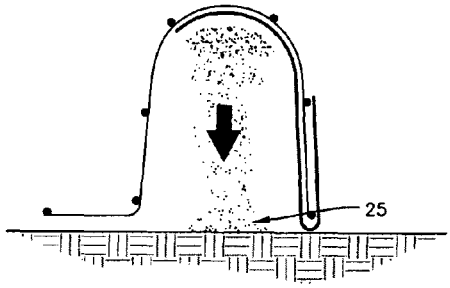
FIG. 10 is a view of the curb inlet filter of FIG. 7 that has collected sediment and debris, 25, and has been removed from a curb inlet and turned upside down to dump out and dispose of the collected sediment and debris.

FIG. 10 is a view showing a curb inlet filter that has collected sediment and debris 25 and has been removed from a curb inlet and turned upside down to dump out and dispose of the collected sediment and debris.

Upon dumping the collected sediment and debris, the curb inlet filter can be returned to service by placing it back into the receiving curb inlet.

The scope of the current invention is not limited to the specific embodiments described above, and variations in dimensions, shapes, materials, filter media, will be apparent to those skilled in the art.

What is claimed is:

1. A storm water curb inlet filter comprising a semi-rigid compression frame comprising a convex inset portion, and an upper retention flange; and filter media supported by at least a portion of the convex inset portion.

2. The storm water curb inlet filter of claim 1 wherein the filter media is selected from the group consisting of a woven mono-filament polypropylene fabric, a non-woven filter fabric, open cell foam rubber, a combination of filter fabric and open cell foam rubber, and a sediment capture tube or roll.

3. The storm water curb inlet filter of claim 1 wherein the compression frame is length adjustable to fit into the target curb inlet.

4. The storm water curb inlet filter of claim 1 wherein the compression frame convex inset portion has a "C" shape.

5. The storm water curb inlet filter of claim 1 wherein the compression frame convex inset portion has a polygonal shape.

6. The storm water curb inlet filter of claim 1 wherein the filter media covers a lower portion of the compression frame convex inset portion; and an upper portion of the compression frame convex inset portion is not covered by filter media, and serves as an overflow area.

7. The storm water curb inlet filter of claim 1 wherein the compression frame is a semi-rigid welded wire frame.

8. The storm water curb inlet filter of claim 1 wherein the compression frame is a plastic frame.

9. A curb inlet storm filter system for a curb inlet comprising a curb comprising a storm water curb inlet, the storm water curb inlet comprising a throat; and a storm water curb inlet filter comprising a semi-rigid compression frame comprising a convex inset portion, and an upper retention lip, and filter media supported by at least a portion of the convex bottom, such that the compression frame is self supported in the curb inlet throat by means of a forced compression fit and requires no additional securing attachments to the curb inlet or a gutter.

10. The curb inlet storm filter system of claim 9 wherein the filter media is selected from the group consisting of a woven mono-filament polypropylene fabric, a non-woven filter fabric, open cell foam rubber, a combination of filter fabric and open cell foam rubber, and a sediment capture tube or roll.

11. The curb inlet storm filter system of claim 9 wherein the compression frame is selected from the group consisting of a welded wire frame and a plastic frame; and the compression frame shape is a "C" shape or polygonal shape.

12. The curb inlet storm filter system of claim 9 wherein the filter media covers a lower portion of the compression frame convex inset portion; and an upper portion of the compression frame convex inset portion is not covered by filter media, and serves as an overflow area.

13. A method of filtering storm water from a curb inlet storm drain, the method comprising providing a storm water curb inlet filter comprising a semi-rigid compression frame comprising a convex bottom portion, and an upper retention element, and filter media supported by at least a portion of the convex bottom, such that the frame and filter media create a sediment and debris collection trough;

inserting the storm water curb inlet filter into the curb inlet by positioning the storm water curb inlet filter in proximity to the curb inlet, pressing the convex bottom portion of the compression frame into the curb inlet so that the convex inset portion is partially compressed, thereby providing a retaining force to hold the compression frame in the curb inlet, and the upper retention element engages an outside portion of the curb inlet, such that the curb inlet filter is substantially flush with the curb; and intercepting and filtering storm water in the storm water curb inlet filter.

14. The method of claim 13 of filtering storm water from a curb inlet storm drain, further comprising removing the storm water curb inlet filter from the curb inlet;

dumping the contents of the filter media; and replacing the storm water curb inlet filter in the curb inlet.

15. The method of claim 13 wherein inserting the storm water curb inlet filter into the curb inlet further comprises adjusting the length of the compression frame to fit into the curb inlet.

16. The method of claim 15 wherein adjusting the length of the compression frame to fit into the curb inlet further comprises providing an extension frame; and overlapping the extension frame to the to the compression frame to fit into the curb inlet.

17. The method of claim 13 wherein the filter media covers a lower portion of the compression frame convex inset portion; and an upper portion of the compression frame convex inset portion is not covered by filter media, and serves as an overflow area.

18. The method of claim 13 wherein the filter media is selected from the group consisting of a woven mono-filament polypropylene fabric, a non-woven filter fabric, open cell foam rubber, a combination of filter fabric and open cell foam rubber, and a sediment capture tube or roll.

19. The method of claim 13 wherein the compression frame is selected from the group consisting of a welded wire frame and a plastic frame; and the compression frame shape is a "C" shape or polygonal shape.

20. The method of claim 13 wherein the filter media covers a lower portion of the compression frame convex inset portion; and an upper portion of the compression frame convex inset portion is not covered by filter media, and serves as an overflow area.

* * * * *